US007386916B2

(12) United States Patent
Bone

(10) Patent No.: US 7,386,916 B2
(45) Date of Patent: Jun. 17, 2008

(54) SELF-CLEANING VACUUM CLEANER AND RECEPTACLE THEREFOR

(75) Inventor: Daniel Bone, Langley Moor (GB)

(73) Assignee: Black & Decker Inc., Newark, DE (US)

( * ) Notice: Subject to any disclaimer, the term of this patent is extended or adjusted under 35 U.S.C. 154(b) by 316 days.

(21) Appl. No.: 10/912,374

(22) Filed: Aug. 5, 2004

(65) Prior Publication Data

US 2005/0091784 A1 May 5, 2005

(30) Foreign Application Priority Data

Aug. 5, 2003 (GB) ..... 0318284.7

(51) Int. Cl.
*A47L 9/20* (2006.01)

(52) U.S. Cl. ..... 15/344; 15/352; 55/299; 55/300

(58) Field of Classification Search ..... None
See application file for complete search history.

(56) References Cited

U.S. PATENT DOCUMENTS

| | | | | |
|---|---|---|---|---|
| 3,591,888 | A * | 7/1971 | Takeda et al. | 15/323 |
| 3,708,962 | A | 1/1973 | Deguchi et al. | |
| 3,731,465 | A * | 5/1973 | Ohira et al. | 55/299 |
| 3,856,488 | A * | 12/1974 | Kato et al. | 55/300 |
| 4,328,014 | A | 5/1982 | Burgoon et al. | |
| 4,665,882 | A * | 5/1987 | Otobe | 123/568.16 |
| 4,718,140 | A | 1/1988 | Johnson et al. | |
| 4,787,923 | A | 11/1988 | Fleigle et al. | |
| 2003/0121121 | A1 | 7/2003 | Koichi et al. | |

FOREIGN PATENT DOCUMENTS

| | | | |
|---|---|---|---|
| EP | 0024636 | | 3/1981 |
| EP | 0413134 | | 2/1991 |
| EP | 0860554 | A2 | 8/1998 |
| EP | 1070478 | A2 | 1/2001 |
| GB | 2311462 | A | 10/1997 |
| JP | 62034523 | A | 2/1987 |
| JP | 5192278 | | 8/1993 |
| JP | 2000254054 | | 9/2000 |

* cited by examiner

*Primary Examiner*—David A Redding
(74) *Attorney, Agent, or Firm*—John Yun; Bruce S. Shapiro; Wesley Muller

(57) ABSTRACT

A self-cleaning vacuum cleaner 1 is disclosed. The vacuum cleaner 1 comprises a housing 2 having an inlet 5 and an outlet 6, and a fan arranged within the housing 2 for causing air to flow through a coarse filter and a fine filter. A vibrator mechanism causes vibration of the fine filter, and the vacuum cleaner 1 has a working condition in which the fan causes air to flow from the inlet 5 to the outlet 6, and a self-cleaning condition in which the vibrator mechanism causes vibrations of the fine filter to cause particles to be released from the fine filter, and in which the housing 2 is opened to enable at least some of the particles released from the fine filter to pass through the coarse filter and out of the housing 2 and into a receptacle 10.

25 Claims, 9 Drawing Sheets

SELF-CLEANING VACUUM CLEANER AND RECEPTACLE THEREFOR

FIELD OF THE INVENTION

The present invention relates to vacuum cleaners, and relates particularly, but not exclusively, to portable vacuum cleaners. The invention also relates to cleaning receptacles for use with such vacuum cleaners.

BACKGROUND OF THE INVENTION

Portable vacuum cleaners are known in which a fan mounted in a housing of the vacuum cleaner causes suction of air into an intake in the housing and expulsion of air from an exhaust in the housing. The stream of air travelling from the intake to the exhaust passes through a coarse filter having a filter element of metal or plastics and then through a fine filter having a pleated filter element of paper or other fibrous material.

Prior art vacuum cleaners of this type suffer from the drawback that it is very difficult to remove dirt from the filters, as a result of which the filters eventually become ineffective.

Preferred embodiments of the present invention seek to overcome the above disadvantages of the prior art.

SUMMARY OF THE INVENTION

According to an aspect of the present invention, there is provided a vacuum cleaner comprising:

a housing having at least one inlet for allowing intake of air and at least one outlet for allowing escape of air;

suction means arranged in the housing for causing air to flow from at least one said inlet to at least one said outlet;

first filter means for preventing passage of particles larger than a first predetermined particle size in air flowing from at least one inlet to at least one outlet;

second filter means for preventing passage of particles larger than a second predetermined size, smaller than said first predetermined size, in air flowing from said first filter means to at least one said outlet; and electrically operated vibrator means for causing vibrations of said first filter means and/or said second filter means;

wherein the vacuum cleaner has a working condition, in which said suction means causes air to flow from at least one said inlet to at least one said outlet, and a self-cleaning condition in which the vibrator means causes vibrations of said first and/or said second filter means.

By providing vibrator means adapted to cause vibrations to release particles from the filter means, this provides the advantage of providing a self-cleaning facility when the vacuum cleaner is not being used. This both prolongs the working life of the filter and increases filter efficiency when the vacuum cleaner is in use.

In a preferred embodiment, said second filter means comprises at least one pleated filter element.

This provides the advantage of increasing the useful surface area of the filter.

Said vibrator means may include a plurality of projections adapted to fit between pleats of at least one said filter element.

This provides the advantage of improving mechanical contact between the filter element and vibrator means thus improving the transmission of vibrations to the filter.

In a preferred embodiment, said housing is adapted to open when mounted to a cleaning receptacle for supporting said vacuum cleaner in said self-cleaning condition.

The vacuum cleaner may further comprise engaging means adapted to open said housing when engaged by a cleaning receptacle.

This provides the advantage that the housing of the vacuum cleaner is automatically opened on mounting to the receptacle and closed on removal from the receptacle.

Said housing may comprise at least one closure member adapted to pivot outwards of said housing to form a respective chute.

The vacuum cleaner may further comprise locking means for releasably locking the or each said closure member in a closed condition.

This provides the advantage of preventing inadvertent opening of the or each said closure member.

The housing may define a hollow handle, wherein air flows through the handle in use in the working condition from at least one said inlet to at least one said outlet.

This provides the advantage of enabling the housing to be of more compact construction than the prior art, and to enable cooling of the handle by means of air flow.

The suction means may be adapted to cause air to flow from at least one said outlet to at least one said inlet in said self-cleaning condition.

The first filter means may have at least one first filter body having a respective working condition, in which said body sealingly engages said housing such that air travelling from the or each said inlet to the or each said outlet is forced through said first filter means, and a respective self-cleaning condition in which said body allows at least some particles retained by said second filter means to pass said first filter means.

In a preferred embodiment, said suction means in use urges at least one said first filter body into a respective working condition thereof.

This provides the advantage that there is no requirement for a mechanism to move the filter body into its respective working condition other than the operation of the vacuum cleaner suction fan. This makes the vacuum cleaner easy to use for the operator and also reduces production costs.

At least one said first filter body may be adapted to move from the respective working condition thereof to the self-cleaning condition thereof under gravity.

This provides the advantage of simplifying construction of the vacuum cleaner and reducing production costs.

In a preferred embodiment, said vibrator means is adapted to cause vibration of at least one said first filter body in a direction substantially parallel to the direction of movement of said filter body from the working to the self-cleaning condition thereof.

The vibrator means may comprise at least one electric motor adapted to drive at least one eccentrically arranged weight.

The vibrator means may include at least one piezoelectric transducer.

The vibrator means may include a loudspeaker.

At least one said loudspeaker may be tuned to cause resonant vibration in said second filter means.

This provides that advantage of increasing the amplitude of the filter vibrations which in turn makes the self-cleaning action more effective.

Said vibrator means may be adapted to derive electrical power from stepped-down mains supply.

According to another aspect of the present invention, there is provided a cleaning receptacle for a vacuum cleaner, the receptacle comprising:

support means for supporting said vacuum cleaner; and electrical connector means for supplying electrical power to said vibrator means.

This provides the advantage that the vacuum cleaner can be left in the receptacle to self-clean.

Said support means may be adapted to support said vacuum cleaner such that said second filter means is located substantially above said first filter means.

This provides the advantage that particles shaken from the second filter means fall under gravity out of the housing.

The receptacle may further comprise a dust collection portion.

The receptacle may further comprise at least one closure member, and biasing means for biasing the or each said closure member towards a closed position.

This provides the advantage that any dust stored in the receptacle is prevented from escaping from the receptacle when the vacuum cleaner is not mounted to the receptacle.

The receptacle may further comprise transformer means for stepping down mains voltage.

The receptacle may further comprise engagement means for engaging said vacuum cleaner to open said housing thereof.

The receptacle may further comprise battery charger means for recharging at least one battery of said vacuum cleaner.

This provides the advantage of simultaneous self-cleaning and recharging of the vacuum cleaner.

One of the vacuum cleaner or the receptacle may further comprise a timer such that said vibrator means is activated for a predetermined time when said vacuum cleaner is mounted to said receptacle.

Said timer may be adapted to be actuated for a time determined by the charge level of at least one battery of the vacuum cleaner.

According to a further aspect of the present invention, there is provided a vacuum cleaner assembly comprising a vacuum cleaner as defined above and a receptacle as defined above.

BRIEF DESCRIPTION OF DRAWINGS

Preferred embodiments of the present invention will now be described, by way of example only and not in any limitative sense, with reference to the accompanying drawings, in which.

DETAILED DESCRIPTION OF DRAWINGS

Figure 1:
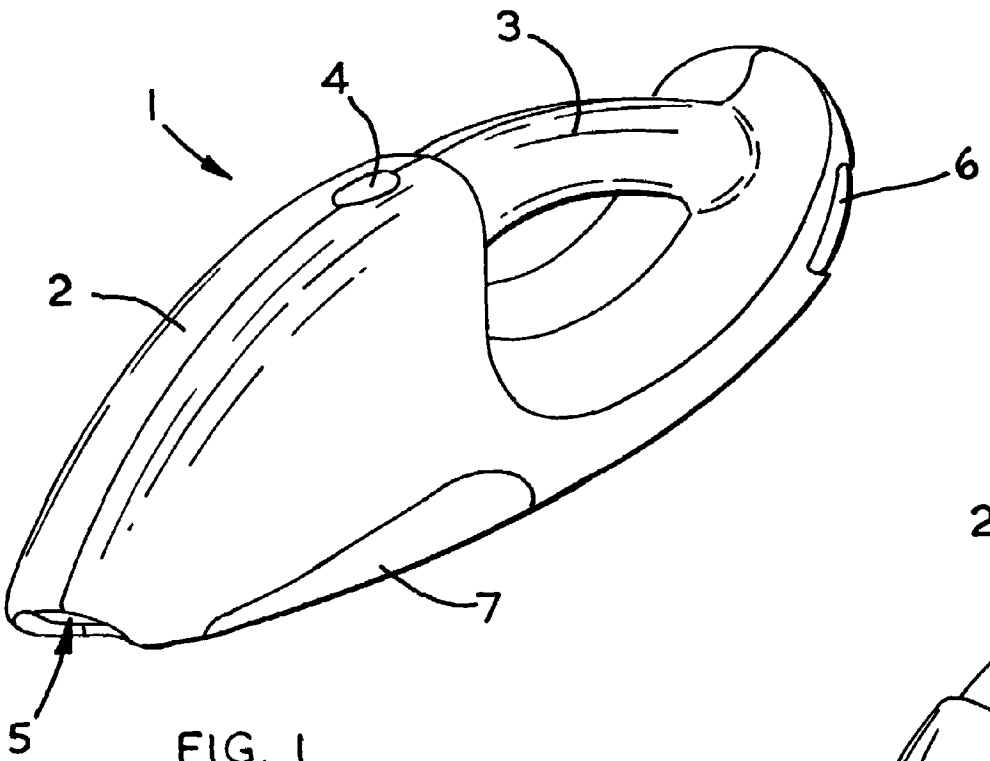
FIG. 1 is a schematic perspective view of a portable vacuum cleaner of the present invention in a vacuum cleaning mode.

Referring to FIG. 1, a vacuum cleaner 1 comprises a housing 2 of durable plastics material. The housing 2 includes an integrally formed handle 3 and a switch 4 for a user to depress, the switch activating a motor (not shown) of the vacuum cleaner 1. An inlet 5 is located at the front of the housing 2. In operation, actuation of the motor causes a fan (not shown) to draw air through inlet 5 and pass it through a filter assembly (not shown) such that dust particles contained in the air are removed. Cleaned air is then passed back into the atmosphere through outlet 6. The vacuum cleaner housing 2 also comprises a hinged door 7, the purpose of which will be described in detail below.

Figure 2:
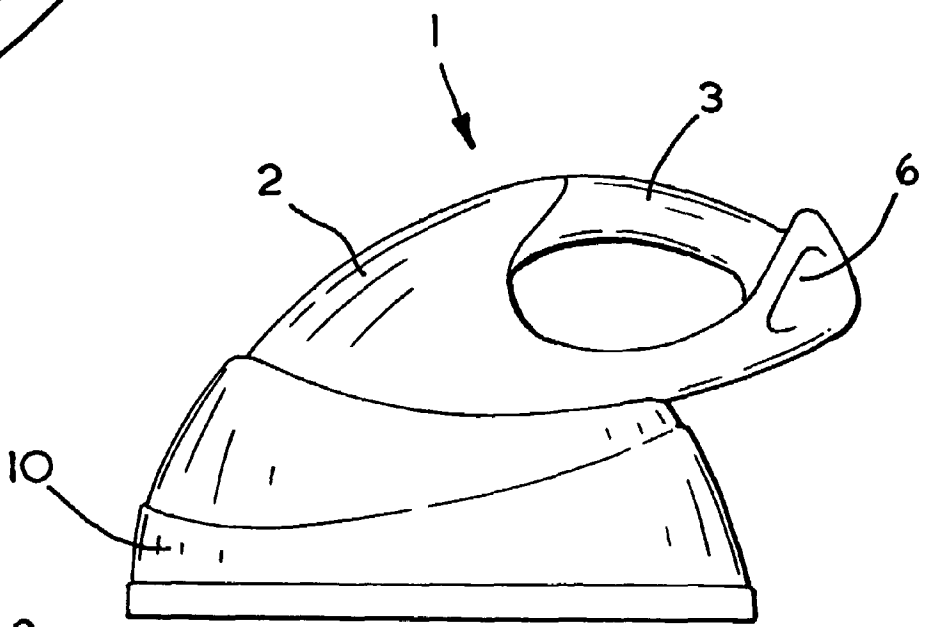
FIG. 2 is a schematic side view of the portable vacuum cleaner of FIG. 1 in a self-cleaning mode and mounted to a cleaning receptacle.

A cleaning receptacle 10 is provided such that vacuum cleaner 1 can be mounted on receptacle 10 when the vacuum cleaner 1 is not in use. When the vacuum cleaner 1 is mounted onto the receptacle 10 as shown in FIG. 2, door 7 is automatically opened on engagement with the receptacle 10 and a vacuum cleaner recharging and cleaning process is automatically commenced.

Figure 3:
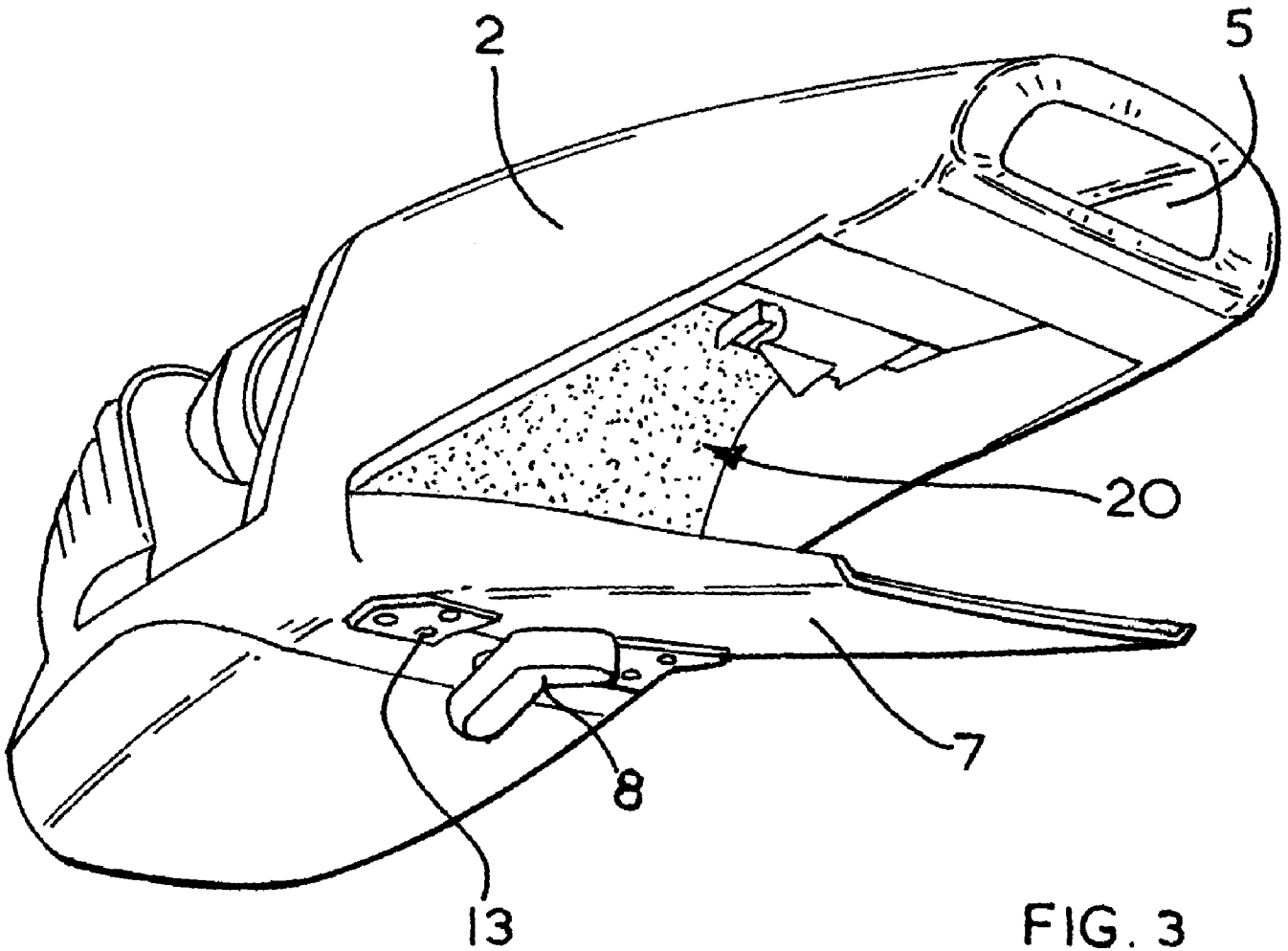
FIG. 3 is a perspective view from below of the vacuum cleaner of FIG. 1 in which the housing is in an open condition.
Figure 4:
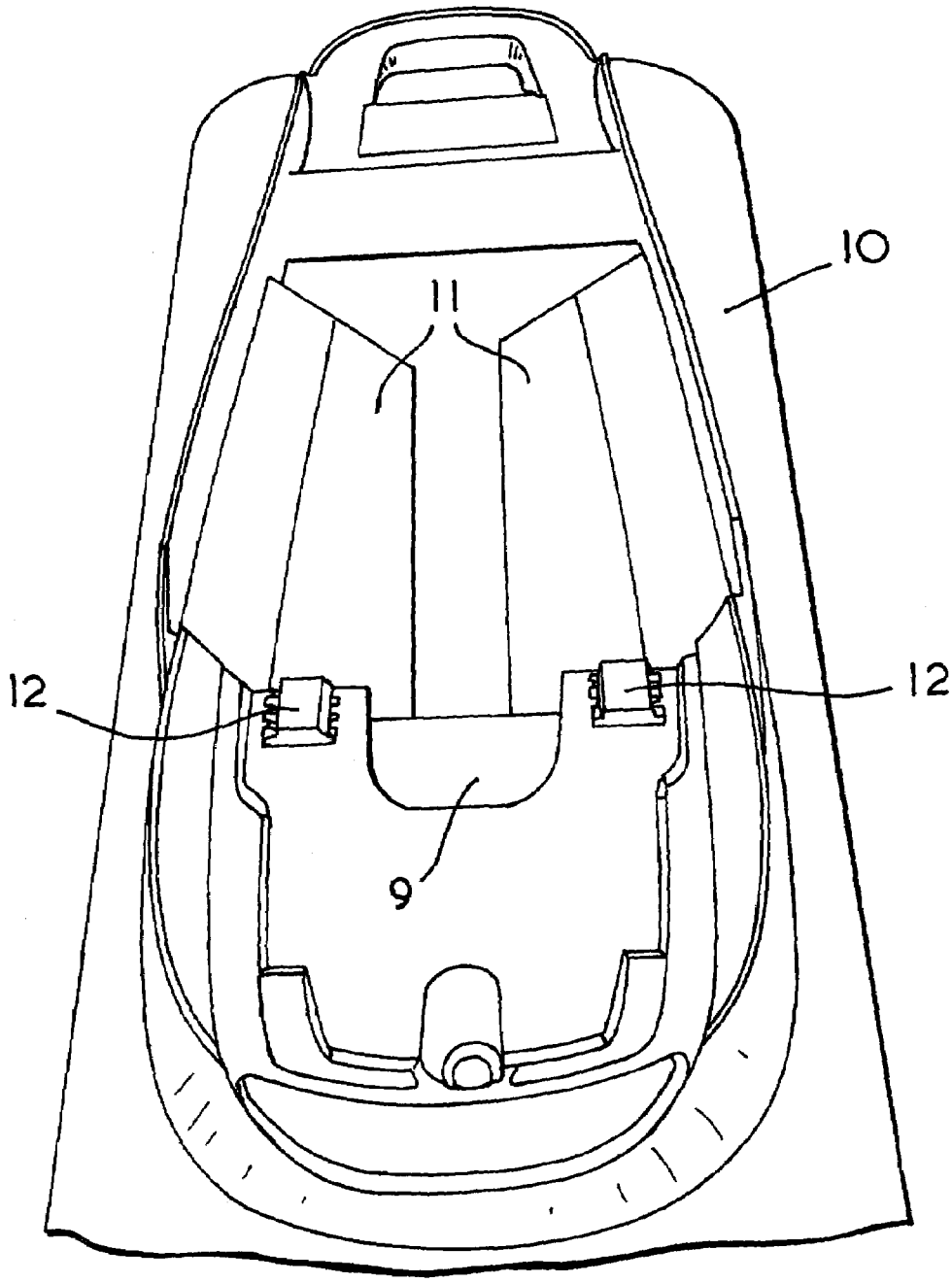
FIG. 4 is a perspective view from above of the cleaning receptacle of FIG. 2.
Figure 5:
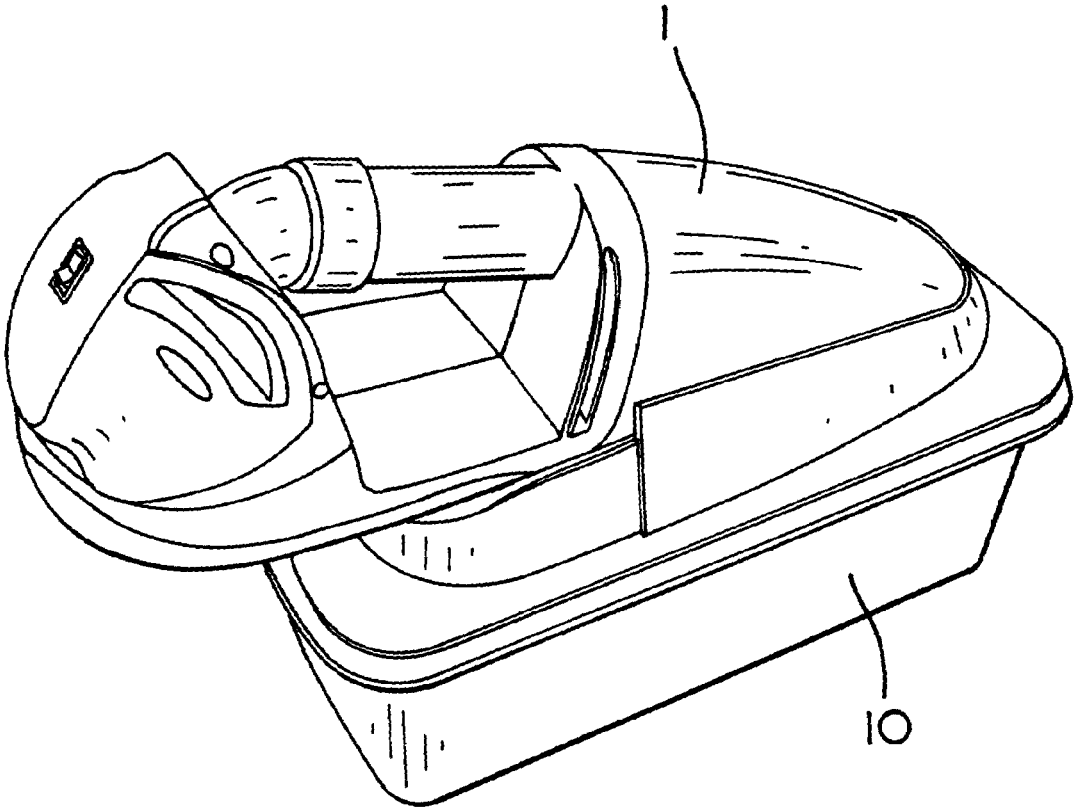
FIG. 5 is a perspective view from above and one side of the vacuum cleaner and cleaning receptacle of FIG. 2.

Referring now to FIGS. 3 to 5, the door 7 of vacuum cleaner 1 comprises a lever 8, and the door 7 is generally biased towards the closed position (as shown in FIG. 1) by a spring (not shown) such as a torsion spring at the hinge between the door 7 and the adjacent part of housing 2. Door 7 can be opened however by applying a sufficient contact force to lever 8 such that the door 7 is pivoted into the open condition as shown in FIG. 3.

Referring now to FIG. 4, receptacle 10 is provided with an engagement surface 9 which cooperates with lever 8 such that when the vacuum cleaner 1 is mounted onto receptacle 10, the door 7 is automatically opened. Receptacle 10 is provided with a set of receptacle doors 11 which are spring loaded towards a closed condition. In FIG. 4, receptacle doors 11 are shown in a partially open condition. Accordingly, when vacuum cleaner 1 is mounted onto receptacle 10, the action of pushing the vacuum cleaner onto the receptacle opens receptacle doors 11, and correspondingly opens vacuum cleaner door 7. This enables loose dirt particles inside door 7 to slide down the chute defined by the open door 7 into the receptacle 10.

The receptacle 10 is also provided with a pair of electrical contacts 12 adapted to contact a further set of electrical contacts 13 disposed on the underside of the housing 2 of the vacuum cleaner 1. These electrical contacts enable charging of rechargeable batteries (not shown) of the vacuum cleaner for energising the vacuum cleaner motor, and also operation of a vibrator mechanism as will be described below.

Figure 6:
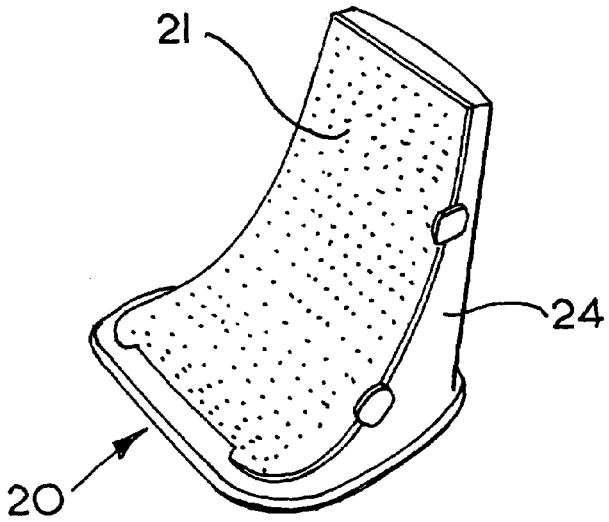
FIG. 6 is a perspective front view of a filter assembly of the vacuum cleaner of FIG. 1.
Figure 7:
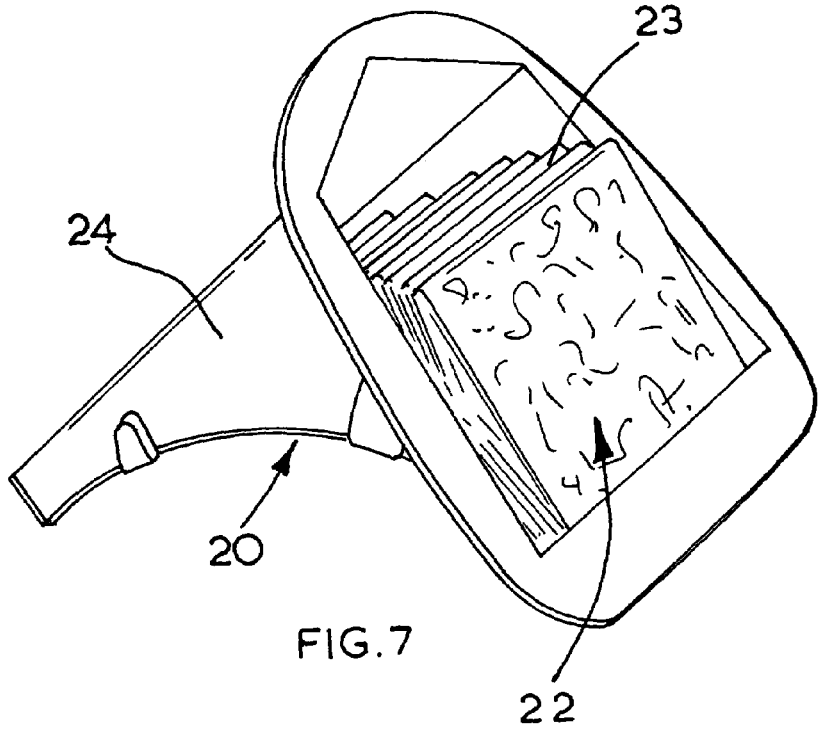
FIG. 7 is a perspective rear view of the filter assembly of FIG. 6.

Referring now to FIGS. 6 and 7, a filter assembly 20 comprises a coarse filter 21 formed from a mesh of plastics or metallic material, and a fine filter 22 having a filter element formed from fibrous paper. The fine filter 22 has a plurality of pleats 23 which increase the working surface area of the fine filter 22, and the coarse filter 21 and fine filter 22 are supported on a frame 24 of durable plastics material.

Referring again to FIG. 3, filter assembly 20 can be seen in position in the housing 2 of the vacuum cleaner 1. When the vacuum cleaner 1 is activated, (it will be appreciated that when the vacuum cleaner is in operation door 7 is in the closed position), the fan (not shown) draws air through inlet 5 and firstly across coarse filter 21, which removes particles larger than a first size, and then across fine filter 22 which removes particles from the air flow that are small enough to pass through coarse filter 21.

Figure 8:
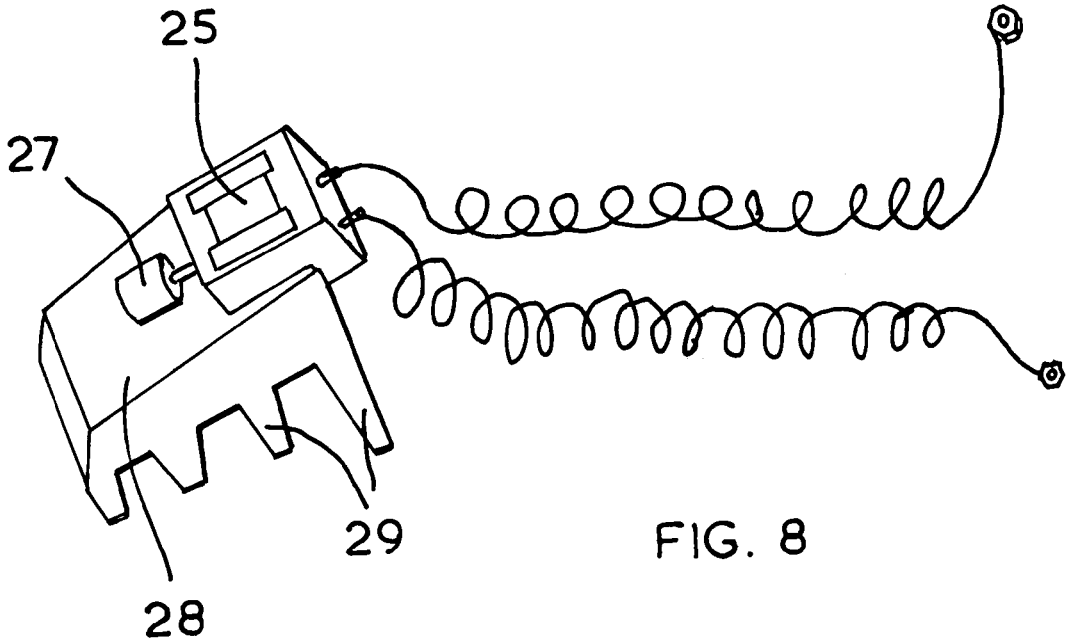
FIG. 8 is a sideways perspective view of a vibrator mechanism of the vacuum cleaner of FIG. 1.

Referring to FIG. 8, a filter vibrator mechanism 25 comprises an electric motor 26 connected to an eccentrically mounted weight 27. When the motor 26 is operated, the eccentrically mounted weight rotates and causes the assembly to vibrate. The motor 26 is mounted on a plastic mounting portion 28 which comprises a plurality of integrally formed teeth 29 which are placed in contact with the pleats of the fine filter 22.

Figure 9:
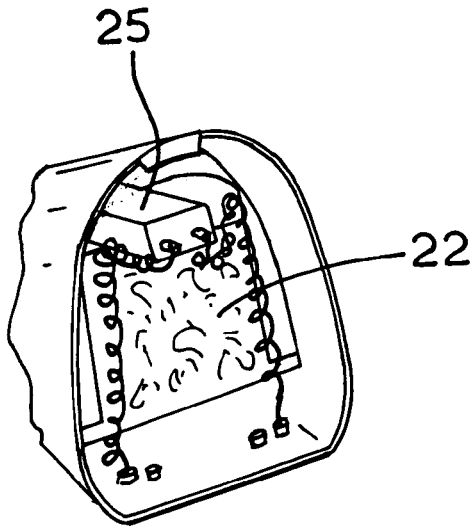
FIG. 9 is a rear cut-away view of a front portion of the vacuum cleaner of FIG. 1 showing the filter assembly of FIG. 8.

As shown in FIG. 9, the vibrator mechanism 25 is attached to the fine filter 22 by virtue of teeth 29 fixedly engaging pleats 23. Consequently, it can be seen that the vibrations caused by eccentrically mounted weight 27 are imparted to the pleats of fine filter 22 such that the filter 22 is vibrated.

The operation of the filter cleaning mechanism will now be described.

In order to recharge the vacuum cleaner batteries (not shown) and clean the fine filter 22, the vacuum cleaner 1 is placed on the cleaning receptacle as shown in FIGS. 2 and 5. In this condition, the vacuum cleaner door 7 is held open and fine filter 22 is located above coarse filter 21.

Mounting of vacuum cleaner 1 onto receptacle 10 causes the respective contacts 12, 13 of the vacuum cleaner and receptacle to come into contact. This automatically begins charging of the rechargeable vacuum cleaner batteries (not shown) and starts the vibrator mechanism 25. Any dust shaken from fine filter 23 is able to fall back through coarse filter 21 and into the receptacle 10 via open door 7.

The receptacle 20 is provided with electronics which link the cleaning cycle, i.e. the length of time that the vibrator 25 is operated for, to the previous operation time of the vacuum cleaner 1. This may be accomplished by sensing the level of battery charge to determine the length of time that the vacuum cleaner has been in operation. There is no requirement for the timing electronics to be present in the receptacle 10, as this could equally be accomplished by locating the electronics in the vacuum cleaner 1.

Figure 10:
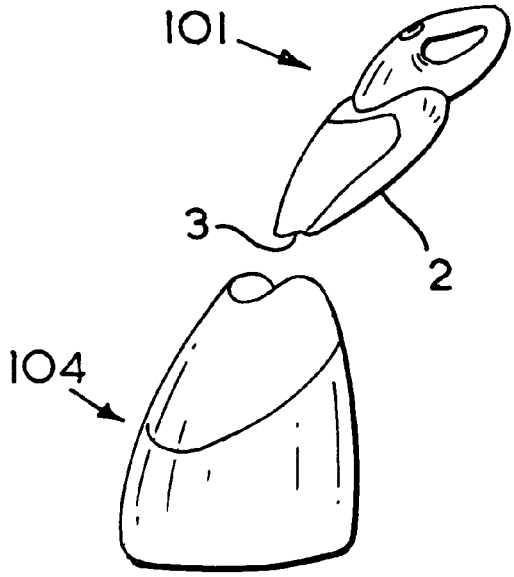
FIG. 10*a* is a schematic perspective view of a second embodiment of a portable vacuum cleaner and cleaning receptacle of the present invention in a vacuum cleaning mode.
FIG. 10*b* is a schematic perspective view of the filter system employed by the vacuum cleaner of FIG. 10*a;*
FIG. 10*c* is a schematic perspective view of the vacuum cleaner loaded into the cleaning receptacle of FIG. 10*a;*
Figure 10B:
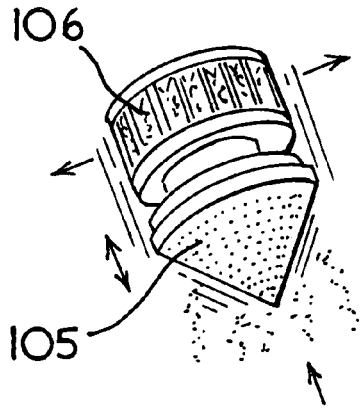
Figure 10C:
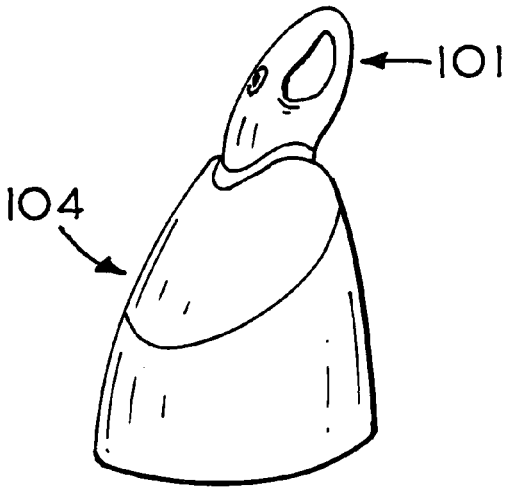
Figure 11:
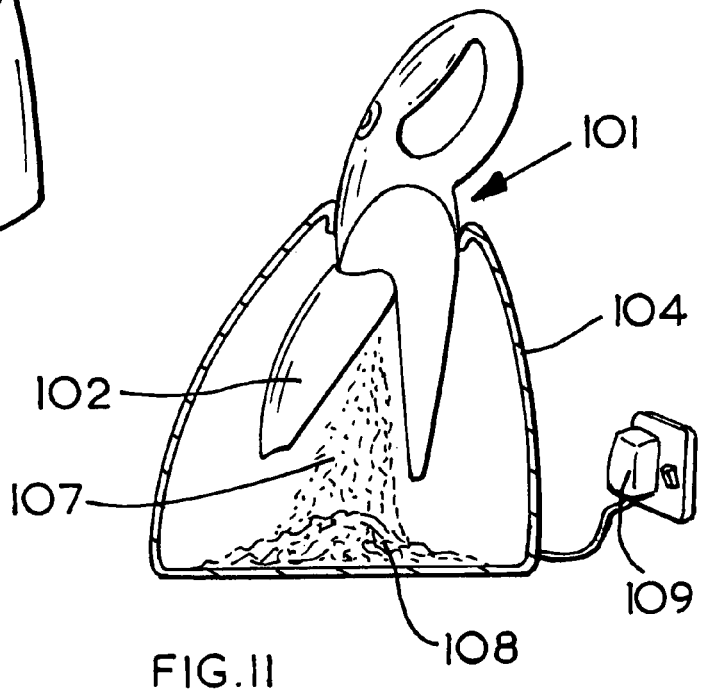
FIG. 11 is a schematic perspective cut away view of the vacuum cleaner of FIG. 10*c* in the self-cleaning mode.
Figure 12:
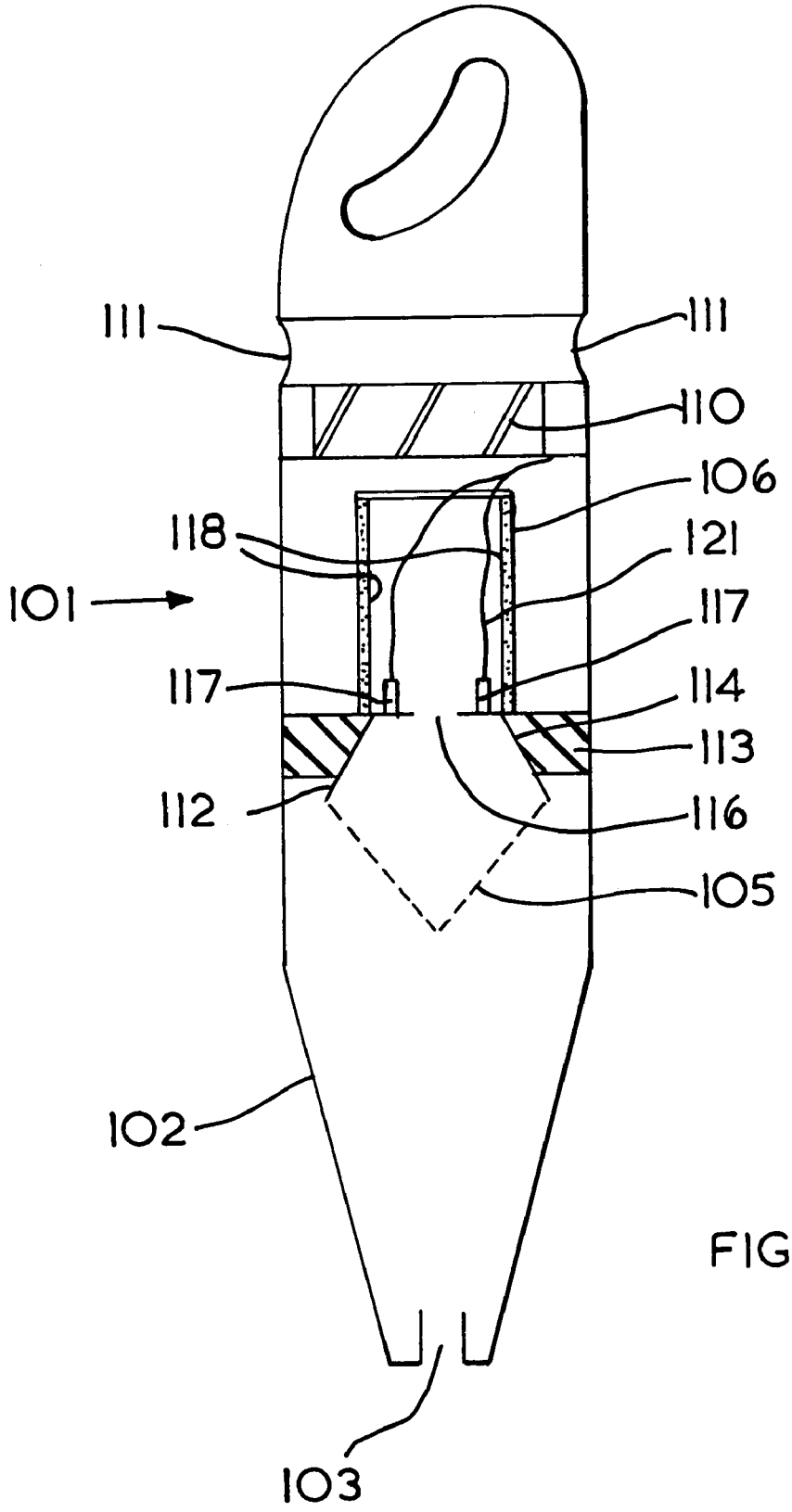
FIG. 12 is a cross sectional view of the vacuum cleaner of FIG. 10*c* in vacuum cleaning mode.
Figure 13:
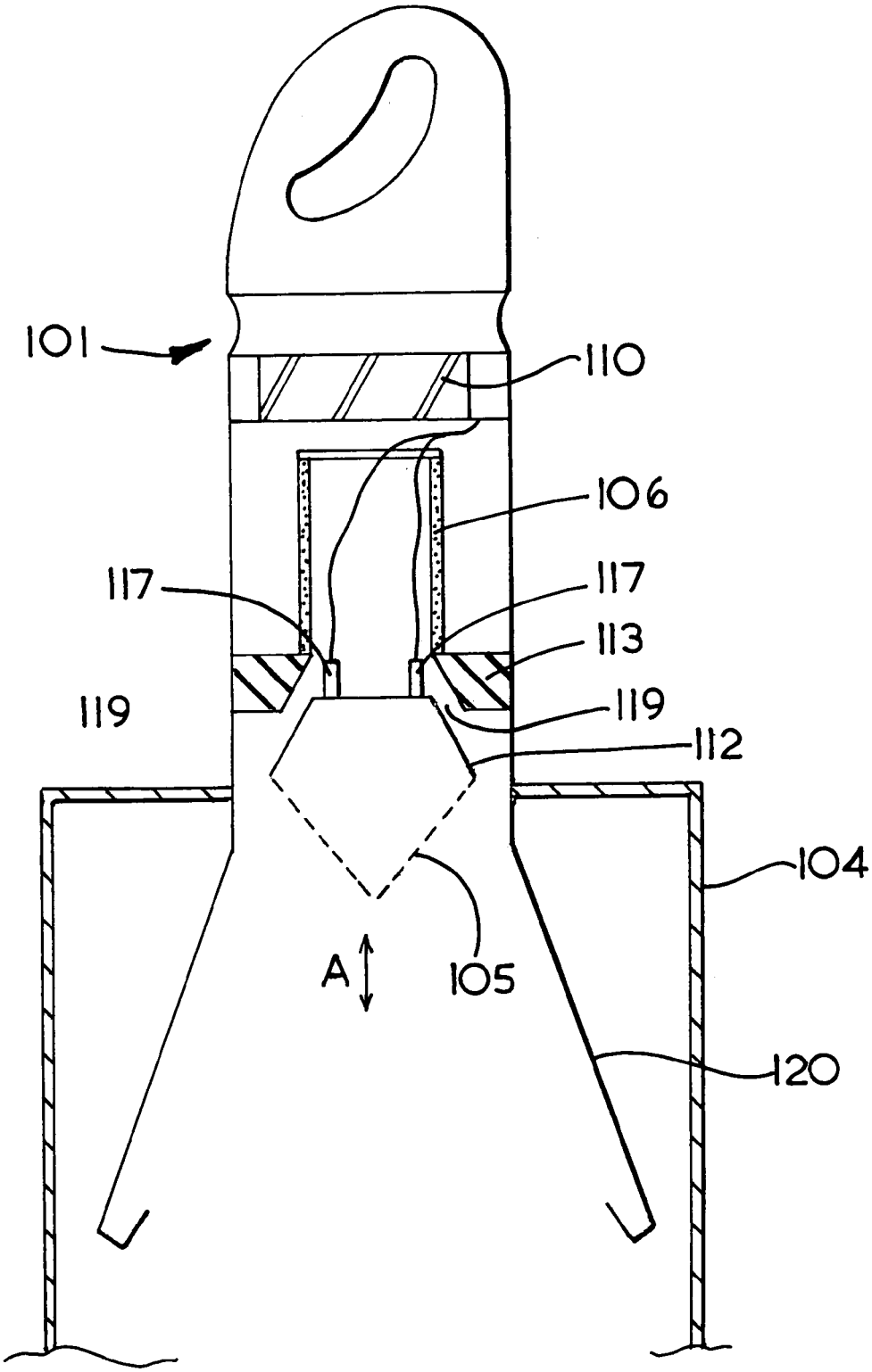
FIG. 13 is a cross sectional view of the vacuum cleaner of FIG. 10*c* loaded into the receptacle in self-cleaning mode.

Referring now to FIGS. 10*a* to 13, a vacuum cleaner 101 of a second embodiment of the present invention includes a housing 102 having an inlet 103 for intake of air and an outlet (not shown) for expulsion of air. The housing portion 102 contains a generally conical coarse filter 105 (FIG. 10*b*) for removing dust particles from air flowing from the inlet 103 to the outlet, and a pleated fine filter 106 for removing smaller particles of dust from air flowing from the coarse filter 105 (FIG. 10*b*) to the outlet (not shown). The coarse filter 105 is moveable axially relative to the housing 102 and fine filter 106 between a working position in which the coarse filter 105 abuts a sealing ring (FIG. 12) to force air travelling from the inlet to the outlet through the filter 105, and a cleaning position in which the filter 105 is spaced from the sealing ring 113 to enable dirt released from the fine filter to pass around the periphery of the coarse filter 105 as shown in FIG. 13. A receptacle 104 is provided to store the vacuum cleaner in an upright position as shown in FIG. 10*c*.

Referring now to FIG. 11, the receptacle 104 is provided such that when the vacuum cleaner 101 is loaded into the receptacle, the housing 102 pivots open to reveal an opening 107 through which dust particles 108 can be released into the receptacle 104. The receptacle 104 is also provided with a battery charger 109 adapted to recharge the vacuum cleaner batteries (not shown).

Referring to FIGS. 12 and 13, the operation of the vacuum cleaner 101 shown in FIGS. 10*a* to 11 will now be described.

Referring to FIG. 12, in the vacuum cleaning mode of vacuum cleaner 101, the fan 110 displaces air through outlets 111 thereby drawing air in through the inlet 103 of the housing 102. The resultant air flow through the vacuum cleaner 101 forces the coarse filter body 112 into contact with a sealing ring 113 at the surface denoted by 114. The coarse filter 105 has a filter body 112, an outlet aperture 116 to allow the escape of air entering through the coarse filter 105, as well as a vibrator 117 such as a piezoelectric transducer or an electric motor having an eccentric weight, with associated power supply wiring 121. The wiring 121 supplies stepped-down mains supply.

In the vacuum cleaning mode shown in FIG. 12, air entering the inlet 103 contains dust particles. The coarse filter element 105 traps dust particles in the air flow larger than a first particle size. Dust particles smaller than this first particle size will pass through the coarse filter 105, into the cup-shaped fine filter 106. The fine filter 106 at least partially traps the smaller dust particles on its inner surfaces 118 in the air flowing from outlet aperture 116 to the fan outlets 111.

Referring now to FIG. 13, the vacuum cleaner 101 is shown loaded into the cleaning receptacle 104. The cleaning receptacle 104 is adapted to open the housing nose portion 120 of the vacuum cleaner housing 102. In the arrangement shown in FIG. 13, the suction fan 110 is deactivated, thereby allowing the coarse filter body 112 to drop into the cleaning position under gravity. In this position, the coarse filter body 112 is no longer in contact with the sealing ring 113, creating an aperture 119 around which dirt particles freed from the fine filter can travel.

The action of loading the vacuum cleaner 101 into the cleaning receptacle 104 activates vibrator 117, to cause the coarse filter body 112 to vibrate in the axial direction shown by arrow A. In this position, dust particles trapped on the fine filter 106 are able to either fall through aperture 119 into the receptacle 104, or into the coarse filter body 112. The vibration of coarse filter body 112 will firstly release any dust particles trapped in the coarse filter 105, and secondly release any smaller dust particles that have fallen into the filter body 112 back through the coarse filter 105. In this way, the vacuum cleaner is self cleaned by the combined action of gravity and the vibration of the coarse filter body 112.

In the cleaning position of FIG. 13, the vacuum cleaner batteries (not shown) are electrically connected to the battery charger 109 of FIG. 11. The same power supply is also used for providing power to the vibration units 117. It can be seen therefore that the vacuum cleaner 101 can be left in the receptacle 104 to simultaneously self-clean and recharge.

It will be appreciated by persons skilled in the art that the above embodiments have been described by way of example only and not in any limitative sense, and that various alterations and modifications are possible without departure from the scope of the invention as defined by the appended claims. In particular, in the second embodiment described above and shown in FIGS. 12 and 13, the cup-shaped filter element 106 is fixed relative to the housing 102 by virtue of being mounted on the sealing ring 113. The cup-shaped fine filter element 106 may be mounted on the coarse filter body 112 such that the fine filter element 106 is also subject to vibration when the vacuum cleaner 101 is in the self-cleaning mode. Also, in the embodiments described, instead of, or in addition to, including a vibrator in the form of an eccentrically mounted weight, the vibrator could also comprise a piezoelectric transducer, a loudspeaker or other means suitable for vibrating the filters.

The invention claimed is:

1. A vacuum cleaner comprising:

a housing having at least one inlet for allowing intake of air and at least one outlet for allowing escape of air;

a suction device arranged in the housing for causing air to flow from at least one said inlet to at least one said outlet;

a first filter for preventing passage of particles larger than a first predetermined particle size in air flowing from at least one inlet to at least one outlet;

a second filter for preventing passage of particles larger than a second predetermined size, smaller than said first predetermined size, in air flowing from said first filter to at least one said outlet; and an electrically operated vibrator for causing vibrations of said first filter or said second filter;

wherein the vacuum cleaner has a working condition, in which said suction device causes air to flow from at least one said inlet to at least one said outlet, and a self-cleaning condition in which the vibrator causes vibrations of said first or second said filter; and wherein said housing is adapted to open when mounted to a cleaning receptacle for supporting said vacuum cleaner in said self-cleaning condition.

2. A vacuum cleaner according to claim 1, wherein said second filter comprises at least one pleated filter element.

3. A vacuum cleaner according to claim 2, wherein said vibrator includes a plurality of projections adapted to fit between pleats of at least one said filter element.

4. A vacuum cleaner according to claim 1, further comprising an enagement surface adapted to open said housing when engaged by a cleaning receptacle.

5. A vacuum cleaner according to claim 1, wherein said housing comprises at least one closure member adapted to pivot outwards of said housing to form a respective chute.

6. A vacuum cleaner according to claim 5, further comprising locking means for releasably locking the closure member in a closed condition.

7. A vacuum cleaner according to claim 1, wherein the housing defines a hollow handle, and air flows through the handle in use in the working condition from at least one said inlet to at least one said outlet.

8. A vacuum cleaner according to claim 1, wherein the suction device is adapted to cause air to flow from at least one said outlet to at least one said inlet in said self-cleaning condition.

9. A vacuum cleaner comprising:

a housing having at least one inlet for allowing intake of air and at least one outlet for allowing escape of air;

a suction device arranged in the housing for causing air to flow from at least one said inlet to at least one said outlet;

a first filter for preventing passage of particles larger than a first predetermined particle size in air flowing from at least one inlet to at least one outlet;

a second filter for preventing passage of particles larger than a second predetermined size, smaller than said first predetermined size, in air flowing from said first filter to at least one said outlet; and an electrically operated vibrator for causing vibrations of said first filter or said second filter;

wherein the vacuum cleaner has a working condition, in which said suction means causes air to flow from at least one said inlet to at least one said outlet, and a self-cleaning condition in which the vibrator causes vibrations of said first or second said filter; and wherein said first filter has at least one first filter body having at least two positions, a first working position in which said body sealingly engages said housing such that air travelling from each said inlet to each said outlet is forced through said first filter, and a second self-cleaning position inside of said housing in which said body allows at least some particles retained by said second filter to pass said first filter.

10. A vacuum cleaner according to claim 9, wherein said suction device urges said first filter body into said working position.

11. A vacuum cleaner according to claim 9, wherein said first filter body is adapted to move from said working position to said self-cleaning position under gravity.

12. A vacuum cleaner according to claim 9, wherein said vibrator is adapted to cause vibration of at least one said first filter body so that the particles fall in a direction substantially parallel to a direction of movement of said filter body from the working to the self-cleaning position.

13. A vacuum cleaner according to claim 1, wherein said vibrator is adapted to drive at least one eccentrically arranged weight.

14. A vacuum cleaner according to claim 1, wherein said vibrator includes at least one piezoelectric transducer.

15. A vacuum cleaner according to claim 1, wherein said vibrator includes a loudspeaker.

16. A vacuum cleaner according to claim 15, wherein at least one said loudspeaker is tuned to cause resonant vibration in said second filter.

17. A vacuum cleaner according to claim 1, wherein said vibrator is adapted to derive electrical power from stepped-down mains supply.

18. A cleaning receptacle for a vacuum cleaner, the receptacle comprising:

a support for supporting said vacuum cleaner;

an electrical connector for supplying electrical power to a vibrator in a vacuum cleaner for cleaning a filter; and a dust collection chamber for collecting particles from the filter.

19. A receptacle according to claim 18, wherein said support is adapted to support said vacuum cleaner such that a second filter is located substantially above a first filter.

20. A receptacle according to claim 18, further comprising at least one closure member, and biasing means for biasing said closure member towards a closed position.

21. A receptacle according to claim 18, further comprising transformer means for stepping down mains voltage.

22. A receptacle according to claim 18, further comprising an engagement surface for engaging said vacuum cleaner to open said housing thereof.

23. A receptacle according to claim 18, further comprising a battery charger for recharging at least one battery of said vacuum cleaner.

24. A receptacle according to claim 18, wherein one of the vacuum cleaner or the receptacle further comprises a timer such that said vibrator is activated for a predetermined time when said vacuum cleaner is mounted to said receptacle.

25. A receptacle according to claim 24, wherein said timer is adapted to be actuated for a time determined by the charge level of at least one battery of the vacuum cleaner.

* * * * *